US005950732A

United States Patent [19]

Agee et al.

[11] Patent Number: 5,950,732

[45] Date of Patent: Sep. 14, 1999

[54] SYSTEM AND METHOD FOR HYDRATE RECOVERY

[75] Inventors: Mark A. Agee; Larry J. Weick; Kenneth L. Agee, all of Tulsa, Okla.

[73] Assignee: Syntroleum Corporation, Tulsa, Okla.

[21] Appl. No.: 09/048,175

[22] Filed: Mar. 25, 1998

Related U.S. Application Data

[60] Provisional application No. 60/042,490, Apr. 2, 1997.

[51] Int. Cl.[6] ..... C10G 2/00; E21B 43/01; E21B 43/34; E21B 43/36

[52] U.S. Cl. ..... 166/354; 37/323; 37/343; 166/352; 166/357; 166/248; 166/267; 166/302; 166/370; 166/372; 166/75.12; 210/170; 299/8; 518/702; 518/703; 585/15

[58] Field of Search ..... 37/310, 317, 323, 37/324, 333, 343, 345; 166/352, 354, 357, 248, 265, 267, 302, 303, 370, 371, 372, 57, 60, 75.12, 105.5; 210/170; 299/3, 8, 9; 518/702, 703; 585/15

[56] References Cited

U.S. PATENT DOCUMENTS

| | | |
|---|---|---|
| 1,746,464 | 2/1930 | Fischer et al. . |
| 1,798,288 | 3/1931 | Wietzel et al. . |
| 2,247,087 | 6/1941 | Herbert . |
| 2,468,494 | 4/1949 | Griffin, Jr. . |
| 2,472,427 | 6/1949 | Johnson . |
| 2,486,243 | 10/1949 | Atwell . |
| 2,500,533 | 3/1950 | Friedman . |
| 2,518,337 | 8/1950 | Krebs . |
| 2,552,308 | 5/1951 | Buchmann et al. . |
| 2,552,737 | 5/1951 | Rees . |
| 2,579,828 | 12/1951 | Johnson . |
| 2,583,611 | 1/1952 | Sullivan, Jr. . |

(List continued on next page.)

FOREIGN PATENT DOCUMENTS

| | | |
|---|---|---|
| B-83575/82 | 10/1985 | Australia . |
| A-17172/92 | 12/1992 | Australia . |
| A-29777/92 | 6/1993 | Australia . |
| 414019 | 2/1936 | Belgium . |
| 0 212 755 A2 | 8/1986 | European Pat. Off. . |
| 0 261 771 A2 | 7/1987 | European Pat. Off. . |
| 0 103 914 B1 | 7/1988 | European Pat. Off. . |
| 0 497 425 A1 | 1/1992 | European Pat. Off. . |
| 0 501 331 B1 | 2/1992 | European Pat. Off. . |
| 0 516 441 A1 | 5/1992 | European Pat. Off. . |
| 0 503 482 B1 | 7/1992 | European Pat. Off. . |
| 0 601 886 A1 | 12/1993 | European Pat. Off. . |

(List continued on next page.)

OTHER PUBLICATIONS

"Kinetics of the Fischer–Tropsch Synthesis Using a Nitrogen–Rich Gas," T. Knutze, et al.; Oil Gas—European magazine, Jan. 1995, pp. 19–24.

"A New Concept for the Production of Liquid Hydrocarbons from Natural Gas," K. Hedden, et al.; Oil Gas—European Magazine, Mar. 1994, pp. 42–44.

"Production of Synthesis Gas by Catalytic Partial Oxidation of Methane with Air," A. Jess, et al.; Oil Gas—European Magazine, Apr. 1994, pp. 23–27.

"Improve Syngas Production Using Autothermal Reforming," T.S. Christensen, Hydrocarbon Processing, Mar. 1994, pp. 39–46.

(List continued on next page.)

*Primary Examiner*—George Suchfield
*Attorney, Agent, or Firm*—Baker & Botts, L.L.P.

[57] ABSTRACT

A system for recovering liquid hydrocarbons from hydrates on an ocean floor includes a vessel, a positioning subsystem coupled to the vessel for holding the vessel in a desired location over a hydrate formation, a hydrate recovery subsystem coupled to the vessel for delivering hydrates from an ocean floor to the vessel and separating gas from hydrates removed from an ocean floor, a gas conversion subsystem coupled to the hydrate recovery subsystem for converting gas to liquids, and a storage and removal subsystem. Excess energy from the gas conversion subsystem is used elsewhere in the system. A method of recovering hydrates from an ocean floor is also provided.

19 Claims, 5 Drawing Sheets

U.S. PATENT DOCUMENTS

| | | | |
|---|---|---|---|
| 2,615,911 | 10/1952 | Williams . | |
| 2,617,709 | 11/1952 | Cornell . | |
| 2,640,843 | 6/1953 | Hill et al. . | |
| 2,660,032 | 11/1953 | Rosenthal . | |
| 2,686,195 | 8/1954 | McAdams et al. . | |
| 2,697,655 | 12/1954 | Dickinson et al. . | |
| 3,549,335 | 12/1970 | Grotz, Jr. . | |
| 3,589,133 | 6/1971 | Lowd et al. | 405/204 |
| 3,590,919 | 7/1971 | Talley, Jr. | 166/357 |
| 3,673,218 | 6/1972 | Cairns et al. . | |
| 3,866,411 | 2/1975 | Marion et al. . | |
| 3,868,817 | 3/1975 | Marion et al. . | |
| 3,916,993 | 11/1975 | Katz | 166/248 |
| 3,920,072 | 11/1975 | Kern | 166/248 |
| 3,920,579 | 11/1975 | Slater . | |
| 3,938,326 | 2/1976 | DeCorso et al. . | |
| 3,959,972 | 6/1976 | Rudolph et al. . | |
| 3,975,167 | 8/1976 | Nierman | 585/15 |
| 3,986,349 | 10/1976 | Egan . | |
| 4,007,787 | 2/1977 | Cottle | 166/267 |
| 4,048,250 | 9/1977 | Garwood et al. | 260/683 |
| 4,072,007 | 2/1978 | Sanday | 60/39.69 |
| 4,074,981 | 2/1978 | Slater | 48/197 |
| 4,075,831 | 2/1978 | McGann | 60/39.05 |
| 4,092,825 | 6/1978 | Egan | 60/39.02 |
| 4,121,912 | 10/1978 | Barber et al. | 48/197 |
| 4,132,065 | 1/1979 | McGann | 60/39.02 |
| 4,147,456 | 4/1979 | Klass | 405/210 |
| 4,158,680 | 6/1979 | McGann | 261/149 |
| 4,184,322 | 1/1980 | Paull et al. | 60/39.02 |
| 4,202,169 | 5/1980 | Acheson et al. | 60/39.12 |
| 4,299,086 | 11/1981 | Madgavkar et al. | 60/39.06 |
| 4,309,359 | 1/1982 | Pinto | 518/705 |
| 4,315,893 | 2/1982 | McCallister | 422/109 |
| 4,328,835 | 5/1982 | Taylor | 137/869 |
| 4,338,292 | 7/1982 | Duranleau | 423/656 |
| 4,341,069 | 7/1982 | Bell et al. | 60/39.02 |
| 4,371,045 | 2/1983 | McGuire et al. | 175/17 |
| 4,372,920 | 2/1983 | Zardi | 422/148 |
| 4,376,462 | 3/1983 | Elliott | 166/267 |
| 4,381,641 | 5/1983 | Madgavkar et al. | 60/39.06 |
| 4,423,022 | 12/1983 | Albano et al. | 423/360 |
| 4,423,156 | 12/1983 | Bussemeier et al. | 518/717 |
| 4,424,858 | 1/1984 | Elliott et al. | 166/52 |
| 4,434,613 | 3/1984 | Stahl | 60/39.07 |
| 4,472,935 | 9/1984 | Acheson et al. | 60/39.06 |
| 4,481,305 | 11/1984 | Jorn et al. | 518/705 |
| 4,492,085 | 1/1985 | Stahl et al. | 60/649 |
| 4,522,939 | 6/1985 | Minderhoud et al. | 502/242 |
| 4,524,581 | 6/1985 | Cascone et al. | 60/39.02 |
| 4,528,811 | 7/1985 | Stahl | 60/39.07 |
| 4,549,396 | 10/1985 | Garwood et al. | 60/39.02 |
| 4,579,985 | 4/1986 | Minderhoud et al. | 585/310 |
| 4,579,986 | 4/1986 | Sie | 585/324 |
| 4,587,008 | 5/1986 | Minderhoud et al. | 208/109 |
| 4,604,961 | 8/1986 | Ortloff et al. | 114/230 |
| 4,618,451 | 10/1986 | Gent | 252/373 |
| 4,640,766 | 2/1987 | Post et al. | 208/111 |
| 4,678,723 | 7/1987 | Wertheim | 429/17 |
| 4,681,701 | 7/1987 | Sie | 252/373 |
| 4,732,092 | 3/1988 | Gould | 110/229 |
| 4,750,983 | 6/1988 | Foster et al. | 204/301 |
| 4,755,536 | 7/1988 | Mauldin et al. | 518/709 |
| 4,778,826 | 10/1988 | Jezl et al. | 518/703 |
| 4,833,140 | 5/1989 | Weber et al. | 514/343 |
| 4,833,170 | 5/1989 | Agee | 518/703 |
| 4,869,887 | 9/1989 | Van Dijk | 423/359 |
| 4,892,495 | 1/1990 | Svensen | 441/5 |
| 4,894,205 | 1/1990 | Westerman et al. | 422/197 |
| 4,919,909 | 4/1990 | Lesur et al. | 423/360 |
| 4,920,752 | 5/1990 | Ehrsam | 62/46.1 |
| 4,946,477 | 8/1990 | Perka et al. | 48/197 |
| 4,946,600 | 8/1990 | Denny et al. | 423/230 |
| 4,973,453 | 11/1990 | Agee | 422/190 |
| 4,999,029 | 3/1991 | Lueth et al. | 48/197 |
| 5,026,934 | 6/1991 | Bains et al. | 585/314 |
| 5,028,634 | 7/1991 | Fiato | 518/707 |
| 5,048,284 | 9/1991 | Lywood et al. | 60/39.02 |
| 5,080,872 | 1/1992 | Jezl et al. | 422/201 |
| 5,126,377 | 6/1992 | Bessell | 518/714 |
| 5,177,114 | 1/1993 | Van Dijk et al. | 518/703 |
| 5,245,110 | 9/1993 | Van Dijk et al. | 585/946 |
| 5,261,490 | 11/1993 | Ebinuma | 166/266 |
| 5,295,350 | 3/1994 | Child et al. | 60/39.02 |
| 5,295,356 | 3/1994 | Billy | 62/20 |
| 5,318,684 | 6/1994 | Cameron | 204/277 |
| 5,324,335 | 6/1994 | Benham et al. | 44/452 |
| 5,324,436 | 6/1994 | John et al. | 210/638 |
| 5,380,229 | 1/1995 | Korsgaard | 441/3 |
| 5,426,258 | 6/1995 | Thomas et al. | 585/15 |
| 5,434,330 | 7/1995 | Hnatow et al. | 585/864 |
| 5,472,986 | 12/1995 | van Dijk | 518/705 |
| 5,473,904 | 12/1995 | Guo et al. | 62/46.1 |
| 5,477,924 | 12/1995 | Pollack | 166/357 |
| 5,500,449 | 3/1996 | Benham et al. | 518/700 |
| 5,504,118 | 4/1996 | Benham et al. | 518/719 |
| 5,506,272 | 4/1996 | Benham et al. | 518/700 |
| 5,520,891 | 5/1996 | Lee | 422/200 |
| 5,527,135 | 6/1996 | Hayashi et al. | 405/184 |
| 5,540,190 | 7/1996 | Rogers et al. . | |
| 5,543,437 | 8/1996 | Benham et al. | 518/700 |
| 5,713,416 | 2/1998 | Chatterji et al. | 166/371 X |
| 5,733,941 | 3/1998 | Waycuilis | 518/703 |

FOREIGN PATENT DOCUMENTS

| | | |
|---|---|---|
| 871230 | 1/1942 | France . |
| 922493 | 4/1947 | France . |
| 1537457 | 7/1968 | France . |
| 60-007929 | of 1985 | Japan . |
| 4364142 | 12/1992 | Japan . |
| 2 103 647 | 8/1984 | United Kingdom . |
| 2 139 644 | 11/1984 | United Kingdom . |
| WO 86/05775 | of 1986 | WIPO . |
| WO 93/06041 | of 1992 | WIPO . |
| WO 95/24961 | of 1995 | WIPO . |
| WO 97/33847 | of 1997 | WIPO . |

OTHER PUBLICATIONS

"The Syntroleum Process" promotional flier, Aug. 1994.

"Gasoline from Natural Gas," P.C. Keith (undated).

"Hydrogen Process Broadens Feedstock Range," Industry & Economic News (undated).

"Autothermal Reforming," Hydrocarbon Processing, Apr. 1984, p. 2.

"Economical Utilization of Natural Gas to Produce Synthetic Petroleum Liquids," K. Agee, et al.; Seventy–fifth Annual GPA Convention, Mar. 11–13, 1996; Denver, Colorado.

"The Mother Lode of Natural Gas," R. Monasterskky, 150 Science News 298, 1996.

"The Fischer–Tropsch Synthesis," R.B. Anderson, Academic Press, Inc.; NY, 1984, pp. 186–191.

"Chemicals Produced in a Commercial Fischer–Tropsch Process," Industrial Chemicals ViaC, Processes, Cpt. 2, M.E. Dry, American Chemical Society Journal, vol. 328, 1987.

"Produce Diesel from Gas," A.H. Singleton, Hydrocarbon Processing, May 1983, pp. 71–74.

"Syn Gas from Heavy Fuels," C.J. Kuhre and C.J. Shearer, (undated).
"Make Syn Gas by Partial Oxidation," C.L. Reed, C.J. Kuhre, Hydrocarbon Processing, Sep. 1979, pp. 191–194.
Malaysia, Shell Mull Gas to Products Project, Oil & Gas Journal, Sep. 16, 1985, p. 62.
"Process Makes Mid–distillates from Natural Gas," Oil & Gas Journal, Feb. 17, 1986, pp. 74–75.
"The Magic of Designer Catalysts," Gene Bylinsky, Fortune, May 27, 1985, p. 82–8.
"Conversion of Natural Gas to Liquid Fuels," R.C. Alden, The Oil and Gas Journal, Nov. 9, 1946, pp. 79–98.
"Fischer–Tropsch Synthesis in Slurry Phase," M.D. Schlesinger, Industrial and Engineering Chemistry, Jun. 1951, pp. 1474–1479.
"Advances in Low Temperature Fischer–Tropsch Synthesis," B. Jager, R. Espinoza, Catalysis Today, vol. 23, 1995, pp. 17–28.
"Fischer–Tropsch Process Investigated at the Pittsburgh Energy Technology Center Since 1944," M.J. Baird, et al., Ind. Eng. Chem. Prod. Res. Dev. 1980, pp. 175–191.
Intl. Search Report Jun. 11, 1997 re PCT/US 97/03729.
Intl. Search Report Oct. 17, 1997 re PCT/US 97/10733.
Intl. Search Report Oct. 24, 1997 re PCT/US 97/10732.
Intl. Search Report Feb. 25, 1998 re PCT/US 97/19722.
Intl. Search Report Jul. 23, 1998 re PCT/US 98/06510.

SYSTEM AND METHOD FOR HYDRATE RECOVERY

RELATED APPLICATIONS

This application claims the benefit of U.S. Provisional Application Ser. No. 60/042,490 filed Apr. 2, 1997.

TECHNICAL FIELD OF THE INVENTION

The present invention relates to the production of hydrocarbons, and more particularly to a system and method for hydrate recovery.

BACKGROUND OF THE INVENTION

Hydrates are a group of molecular complexes referred to as clathrates or clathrate compounds. Many of these complexes are known involving a wide variety of organic compounds. They are typically characterized by a phenomenon in which two or more components are associated without ordinary chemical union through complete enclosure of one set of molecules in a suitable structure formed by the other. A gas hydrate may thus be regarded as a solid solution in which the hydrocarbon solute is held in the lattice of the solvent water.

Methane and other hydrocarbons are known to react with liquid water or ice to form solid compounds that contain both water and individual or mixed hydrocarbons, which are a form of hydrocarbon hydrates. These gas hydrates vary in composition depending upon the conditions, but two compositions that may form are as follows:

$CH_4 5.75H_2O$ and $C_3H_8 17H_2O$

It has been predicted that enormous amounts of methane hydrates are located on the ocean floor at certain sites. See, e.g., Richard Monastersky "The Mother Load of Natural Gas, " 150 Science News 298 (1996).

If the methane hydrates under the ocean could be efficiently and effectively removed in the form of gas, a tremendous source of fuel would be available to mankind. Efforts made to develop methods and apparatuses for the removal of such hydrates have had shortcomings and appear to have rendered hydrate removal impractical or uneconomical.

SUMMARY OF THE INVENTION

In accordance with the present invention, a system and method for hydrate recover are provided that substantially eliminate or reduce disadvantages and problems associated with previous techniques and systems attempting hydrate recovery. According to an aspect of the present invention, a system for recovering gas from hydrates on an ocean floor includes a vessel, a positioning subsystem coupled to the vessel for holding the vessel in a desired location over a hydrate formation, a hydrate recovery subsystem coupled to the vessel for delivering hydrates from an ocean floor to the vessel and separating gas from hydrates removed from an ocean floor, a gas conversion subsystem coupled to the hydrate recovery subsystem for converting gas to liquids, and a storage and removal subsystem.

In accordance with another aspect of the present invention, a hydrate-recovery subsystem includes a main conduit and a collector for receiving hydrates from the ocean floor. According to other aspects of the present invention a hydrate-recovery subsystem may include a gas injection conduit for setting up a self-sustaining gas flow from the hydrates, an internal liquid delivery conduit for causing liquid to be delivered onto the hydrates, a collector formed of conductive portions for creating an electrically current therebetween across the hydrates, a collector with a plurality of heating elements, and/or a collector with an agitator unit for stirring up the hydrates.

According to another aspect of the present invention, a gas conversion subsystem for use with a system for recovering liquid hydrocarbons from hydrates on an ocean floor includes a synthesis gas unit for producing a synthesis gas, a synthesis unit coupled to the synthesis gas unit for converting the synthesis gas to liquid hydrocarbons, and a turbine coupled to the synthesis unit and synthesis gas unit, the turbine for compressing air provided to the synthesis gas unit and developing energy to power the gas-conversion subsystem and at least a portion of a hydrate-recovery subsystem.

According to another aspect of the present invention, a method is provided that includes the steps of positioning a vessel over a hydrate formation on the ocean floor, delivering hydrates into a conduit wherein the hydrates decompose to include a gas, delivering the gas to a synthesis gas conversion system, using the synthesis gas conversion system to convert the gas to liquid hydrocarbons; and using energy from the synthesis gas conversion system in the step of delivering hydrates into the conduit.

A technical advantage of the present invention is that excess power from a conversion process may be used to efficiently recover hydrates from an ocean floor. According to another technical advantage of the present invention, power-enhanced recovery techniques allow for quick removal of hydrates.

BRIEF DESCRIPTION OF THE DRAWINGS

A more complete understanding of the invention and its advantages will be apparent from the detailed description taken in conjunction with the accompanying drawings in which.

DETAILED DESCRIPTION OF THE INVENTION

Figure 1:
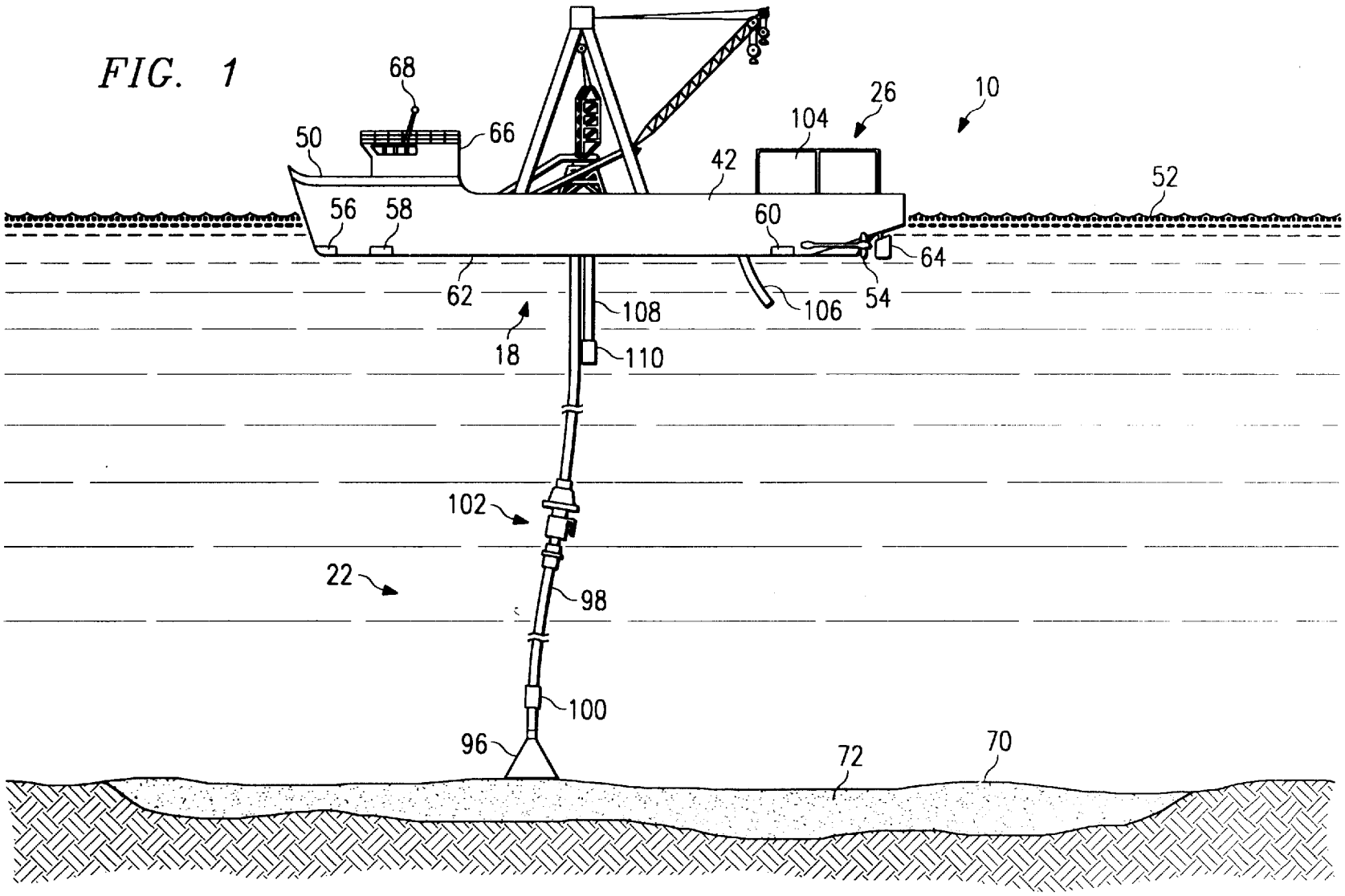
FIG. 1 is a side elevation view schematically presenting one embodiment of the present invention.

The preferred embodiments of the present invention and its advantages are best understood by referring to FIGS. 1–8 of the drawings, like numerals being used for like and corresponding parts of the various drawings.

A. INTRODUCTION

Referring to FIGS. 1–8, the present invention may be used to recover gas-containing hydrates, which may hold methane gas. The hydrates may be recovered from the floor of a large body of water, such as an ocean floor, and will be referred throughout this application as an ocean floor. The system 10 and 12 includes a ship or vessel 14 and 16, a positioning subsystem 18 and 20, a hydrate recovery subsystem 22, 23, 24, 25, 27, and 29, a gas conversion subsystem 32 and 34, and a storage and removal subsystem 42 and 44. These components and the methodology for recovering hydrates are described below along with additional aspects of the present invention.

B. VESSEL AND POSITIONING SUBSYSTEM

Any number of platforms may be used to allow the system 10 and 12 to be positioned over a portion of the ocean floor for the recovery of hydrates, but preferably either a ship or vessel with self-positioning capability or a vessel or ship with a mooring system is used. Referring to FIG. 1, vessel or ship 50 is shown on an ocean surface 52. The ship or vessel 50 may be a dynamic self-positioning vessel having a stern thruster 54, a bow thruster 56, a side-bow thruster 58 and a side-stern thruster 60 mounted within horizontal tunnels penetrating the hull 62 from side-to-side. The thrusters 58 and 60 provide controllable lateral thrust at the stern and bow of vessel 50 in order to control the heading and side-to-side motion of vessel 50 without having to rely on forward motion of vessel 50 to provide lateral action of the ship's rudder 64. The thrusters 54, 56, 58, and 60 can be powered by controlled power takeoffs from the main propulsion engine or by an independent thruster propulsion engines (not shown) within the hull 62 that is powered by the excess energy of a gas conversion subsystem.

Vessel 50 may have a control center or cabin 66 providing manual or automated control of thrusters 54, 56, 58 and 60. The automated control of thrusters 54, 56, 58 and 60 may be coupled with a global positioning system (GPS) system having a GPS equipment 68 for receiving satellite-based positioning information. subsystem 18 will then use the thrusters 54, 56, 58 and 60 to maintain a desired position relative to the ocean floor or bottom 70. Thus, once a hydrate deposit or formation 72 is located, the boundaries of the formation may be preset into the GPS equipment such that a pre-defined pattern may be traced out by vessel 50 over the hydrate formation 72 while hydrate recovery subsystem 22 collects hydrates from the ocean floor 70.

Alternatively, the GPS equipment 68 may be used to hold vessel 50 in a stationary position until an operator has determined that a new position should be assumed by vessel 50. Thus, positioning subsystem 18 may include GPS equipment 68 and thrusters 54, 56, 58 and 60 as well as manual controls and rudder 64. Positioning subsystem 18 may hold vessel 50 in a desired position with respect to the ocean floor 70 while hydrate recovery subsystem 22 is used to collect hydrates from hydrate deposit or formation 72. Vessel 50 may have other features and systems.

Figure 2:
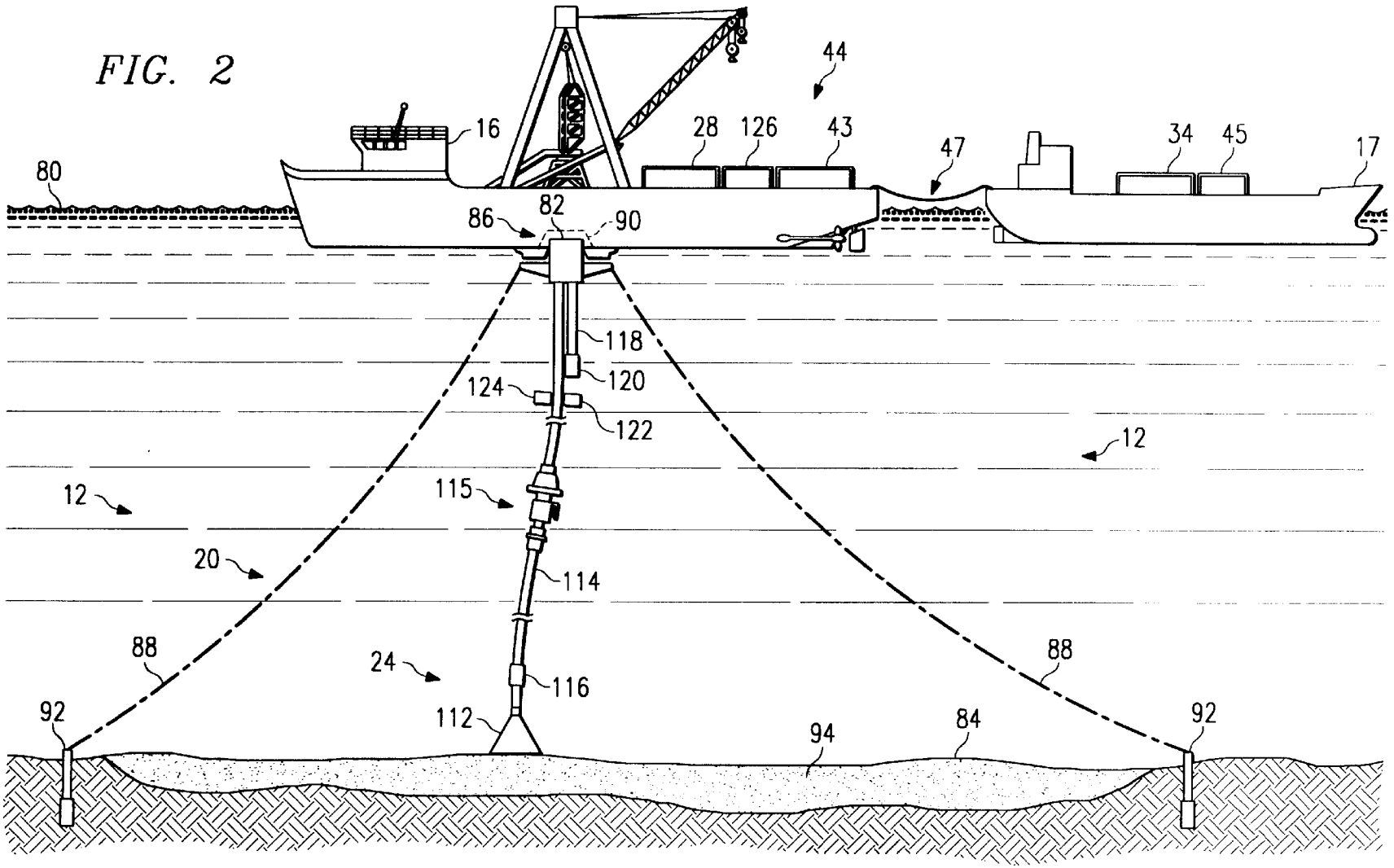
FIG. 2 is a side elevation view schematically showing another embodiment of the present invention.

Referring now to FIG. 2, ship or vessel 16 is shown on an ocean surface 80. The vessel 16 may be a semi-permanently moored converted tanker or a special purpose vessel known as a floating storage and off-loading (FSO) vessel or a floating production storage and off-loading (FPSO) vessel. These vessels are designed to remain on station permanently, unless oncoming severe storm or ice flow conditions threaten damage to or loss of the vessel.

Vessel 16 is used with the positioning subsystem 20 which may be a buoy loading system. Such systems use, instead of a floating or semi-submersible production platform, a submerged or subsurface buoy 82 which forms a connection point for one or more flexible risers or conduits from the ocean floor 84. Buoy 82 is designed to stand in an equilibrium position in the water and to be able to rise and be attached to a complimentary turret subsystem 86 in vessel 16. Usually the buoy 82 is anchored to the bottom of the ocean 84 with a plurality of anchoring or catenary chains 88 such that the buoy 82 is positioned in a stable equilibrium position at the desired water depth and along the vertical axis. Catenary anchor lines 88 are attached on one end to buoy 82 and the other end may be connected to stake piles 92, or otherwise held relatively secured on ocean floor 84.

Buoy 82 is dimensioned such that it has sufficient buoyancy to carry the weight and the loading from anchor chains 88 as well as the weight of any risers while assuming a predetermined neutral position which may be called the stowage position in the water. Buoy 82 will be given sufficient buoyancy such that it may be raised into contact with vessel 16 positioned above buoy 82 with the help of winches and wire systems or it can be brought up under its own buoyant force. Vessel 16 may have a loading system, described as a downwardly opening tunnel or shaft 90, which has a rotatable turret subsystem 86 for receiving buoy 82 and attaching to it. Buoy 82 and turret 86 allow for the wind and weather to rotate vessel 16 with respect to buoy 82, i.e. to weathervane. Any number of other mooring systems may be used as positioning subsystem 20 in connection with the system 12. Another example of a vessel mooring system is shown in U.S. Pat. No. 4,604,961 entitled Vessel Mooring System, which is incorporated herein by reference for all purposes.

Positioning subsystem 20 with catenary anchor lines 88, stake piles 92, buoy 82, and turret 86 hold vessel 16 in a relative position with respect to ocean floor 84 while hydrate recovery system 24 is used to collect hydrates from a hydrate deposit or formation 94. Vessel 16 may be used to hold the processing subsystem 28 as well as all or portions of the storage and removal subsystem 44.

C. HYDRATE RECOVERY SUBSYSTEM

In general, hydrates may be removed from the ocean surface by several techniques. One technique includes reducing the pressure immediately above the surface of the hydrates to a value at which decomposition of the hydrates occurs at the ambient temperature at the surface of the hydrates. Hydrates may also be removed by warming the hydrates to a temperature at which the hydrates decompose at the pressure at the surface of the hydrates. Hydrates may also be removed by introducing catalyzers onto the surface to induce hydrate decomposition. Catalyzers are merely freezing point depressants such as methanol or ammonia. A combination of these techniques may be utilized also. All of these and other similar techniques might be used as an aspect of a hydrate recovery subsystem and, in many instances, may use excess energy from the gas conversion subsystem.

Referring again to FIG. 1, hydrate recovery subsystem 22 may include a collector 96, which is a tent or device that is placed against a hydrate formation such as formation 72. Collector 96 is used initially to remove hydrates 72 from ocean floor 70. Collector 96 is fluidly connected to a conduit 98 running between collector 96 and vessel 50. Attached to conduit 98 proximate collector 96 may be a safety control valve 100. On an intermediate portion of conduit 98 may be a dump valve 102. Safety control valve 100 may be controlled from vessel 50 to restrict the flow of fluid and hydrates from collector 96 into conduit 98 or to completely shut off the flow in conduit 98 which may be necessary since system 22 may be self powered to a large extent as will be described further below. Dump valve 102 may be provided to remove any mud or sediment or other particles lifted from the ocean floor 70 from conduit 98 during shutdown of delivery by subsystem 22. Dump valve 102 may be, for example, a valve analogous to that shown in U.S. Pat. No.

4,328,835, entitled Automatic Dump Valve, which is incorporated herein by reference for all purposes.

There are numerous techniques that may be used as an aspect of the present invention to remove hydrates 72 from ocean floor 70 to vessel 50 where the gas from the hydrates may be converted to a liquid for transport to shore. With the embodiment of FIG. 1, a lower pressure than ambient pressure on the ocean floor 70 is created in collector 96 causing mud and sediment that may hold hydrates 72 to the ocean floor to be removed while also lowering the pressure over hydrate 72 sufficiently to cause portions of hydrates 72 to be drawn into collector 96 and into conduit 90. With a reduction of pressure in collector 96 and conduit 98 and as the pressure decreases as the hydrates are moved through conduit 98 towards ocean surface 52, the hydrates are converted to gas and water as the gas escapes from the lattice. Any of a number of a liquid-gas separators 104 may be used in the embodiment shown. Separator 104 may be, for example, centrifuge separator.

Once the gas is removed from the product delivered through conduit 98 to vessel 50, the liquid portion may be discharged through discharge outlet 106 of vessel 50. To start the flow of hydrates and fluid from ocean floor 70 into collector 96, a gas injection line 108 may be used along with a controllable gas lift valve 110. To start the flow in conduit 98, valve 100 and valve 102 remain open while gas such as methane or air may be injected from line 108 through valve 110 into conduit 98 causing a low pressure to occur in conduit 98 proximate and above the gas lift valve 110 causing flow to begin in conduit 98. Gas lift valve 110 may then continue to supply gas as necessary to maintain the desired pressure differential in that portion of conduit 98. Because hydrates recovered from ocean floor 70 through collector 96 will release the gas locked within them, gas bubbles will form in conduit 98 causing its own pressure lift such that the continuous injection of gas through line 108 will typically not be required unless a faster or stronger negative pressure is desired in collector 96. Because the flow in conduit 98 may be self-sustaining, the need to control the flow rate and to be able to terminate the flow in conduit 98 is handled by valve 100, and as previously noted, dump valve 102 may be used to help remove solid particles from line 98. Numerous dump valves 102 may be supplied to conduit 98 if desired.

Referring to FIG. 2, hydrate recovery system 24 is shown with a collector 112, conduit 114, safety control valve 116, gas injection line 118, and gas lift valve 120.

Also, dump valve 115 may be placed in conduit 114 for the removal of solids from conduit 114 during shutdown. As to these features, they function analogous to corresponding elements shown in FIG. 1, but system 24 also includes an inlet 122, and an intermediate liquid outlet 124. Inlet 122 and outlet 124 may be selectively open and closed by valves not explicitly shown. System 24 may be operated identically to that of FIG. 1, but alternatively, inlet 122 may allow brine or seawater into a center pipe located in conduit 114 that fluidly connects inlet 122 down to a lower portion of collector 112 such that when conduit 114 is supplied with a negative pressure through initiation by gas injection line 118 of valve 120, liquid is pulled into inlet 122 and further delivered to ocean floor 84. This facilitates removal of hydrates 94. Outlet 124 may be used to remove some or all of the brine or water traveling through conduit 114. Alternatively, all of the liquids may be removed with a gas-liquid separator 126 on ship 16.

Figure 3:
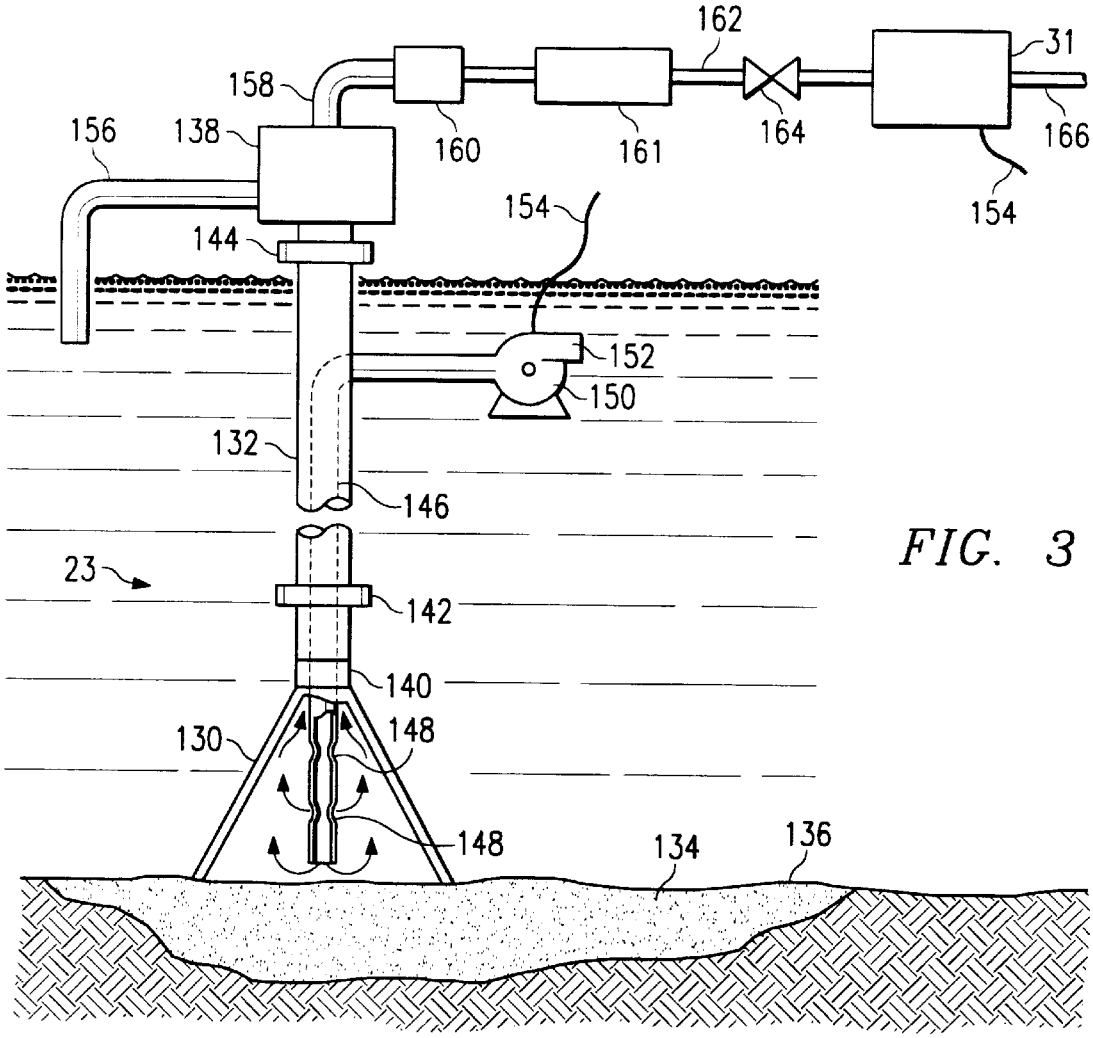
FIG. 3 is a side elevation view of a portion of an embodiment of an aspect of the present invention.

Referring to FIG. 3, another hydrate recovery subsystem 23 is shown. Subsystem 23 has a collector 130 and conduit 132. Conduit 132 is used to carry hydrates from a hydrate formation 134 on ocean floor 136 to a gas-liquid separator 138. A safety control valve 140 may be attached to conduit 132 to control the flow rate therethrough or to completely close it off as selectively operated from a vessel. A dump valve 142 may also be included in conduit 132 to provide for the removal of solids from conduit 132 during shutdown (intentional or unintentional) of the flow in conduit 132. Because of the pressures and flow created in conduit 132 once hydrates 134 are caused to enter and are converted to gas therein, it may be desirable in a number of situations to include a blowout preventer 144.

An internal liquid delivery conduit 146 may be run through a portion of conduit 132. Internal liquid delivery conduit 146 may deliver ocean water or brine from an intermediate portion on conduit 132 down into collector 130. The portion of internal liquid delivery conduit 146 within collector 130 may include a number of perforations 148 which help facilitate agitation of hydrates 134 so that the lower pressure in collector 130 as well as the liquid transport provided by fluid delivered from conduit 146 may help deliver the hydrates 134 into conduit 132.

To cause liquid to flow in conduit 146, a pump 150 may be provided between inlet 152 and internal liquid delivery conduit 146. Pump 150 may be powered with power line 154 using excess energy from a gas conversion subsystem 31. In operation, pump 150 may only be needed to start the flow of hydrates 134 into conduit 132, and because the release of gas from hydrates 134, it may be self-propelling or self powered. Pump 150 may continue to operate, however, to further enhance the speed of removal of hydrates 134 from ocean floor 136.

The liquids and gasses delivered through conduit 132 are provided to a gas-liquid separator 138. Gas-liquid separator 138 may discharge the liquid portions through a discharge outlet 156. The gas separated with separator 138 may be delivered to conduit 158, which may include a number of filters such as filter 160 if desired or may deliver directly to a gas conversion subsystem 31 or to a gas storage 161 where it may be delivered through yet another conduit 162 regulated with a valve 164 to gas conversion subsystem 31. As described further below, gas conversion subsystem 31 will convert the gas to liquid hydrocarbons which may be delivered through one or more conduits 166 to a storage and removal subsystem.

Figure 4:
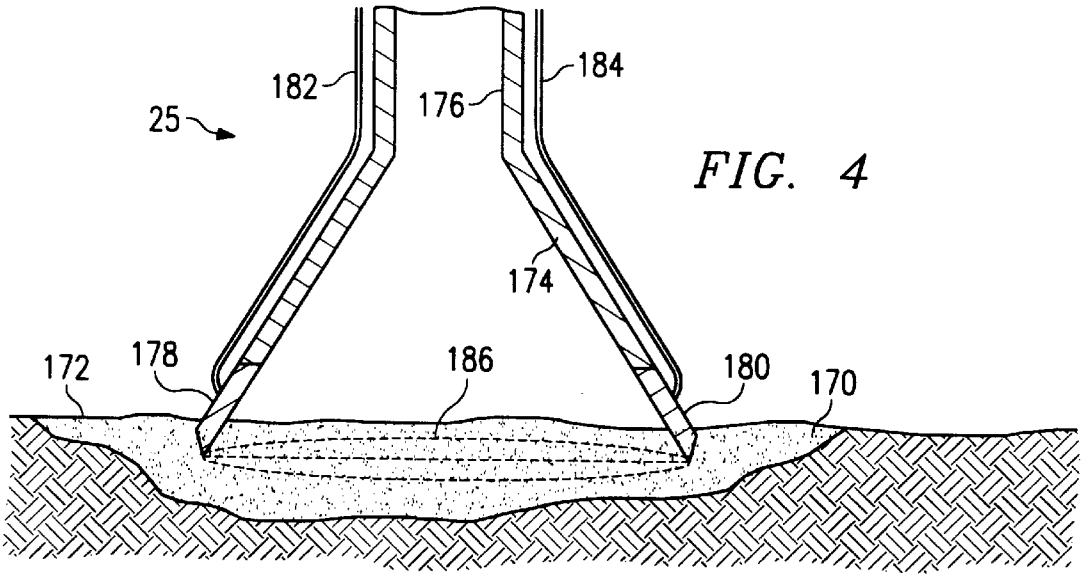
FIG. 4 is a side elevation view in cross-section of a collector according to an aspect of the present invention.

Referring to FIG. 4, another hydrate recovery subsystem 25 is shown. Subsystem 25 may be used with any number of the features shown in the previous hydrate recovery systems as a primary means of causing hydrates 170 on ocean floor 172 to flow into collector 174 or as a secondary system to help supplement the rate of delivery into conduit 176. Subsystem 25 may include a first electrode 178 and a second electrode 180. Electrode 178 may form one-half of collector 174, e.g., if collector 174 is circular it may be formed as almost 180 degrees of collector 174. Electrode 180 may similarly be formed opposite electrode 178 with a small insulation material provided between electrode 178 and electrode 180. Conductive line 182 may be used to supply electrical power to electrode 178 with the second portion of a flow path being created by electrode 180 and conductive line 184. With this arrangement, a current may be generated in hydrate 170 flowing from electrode 178 through hydrate 170 to electrode 180 as shown generally by reference numeral 186. The electrodes may be powered by excess power for the gas to liquids subsystem. With respect to passing a current from different parts of the collector 174, the methodology would be similar to passing a current from a first electrode to a second electrode in a subterranean formation as shown by U.S. Pat. No. 3,920,072, entitled Method of Producing Oil from a Subterranean Formation, which is incorporated by reference herein for all purposes.

Figure 5:
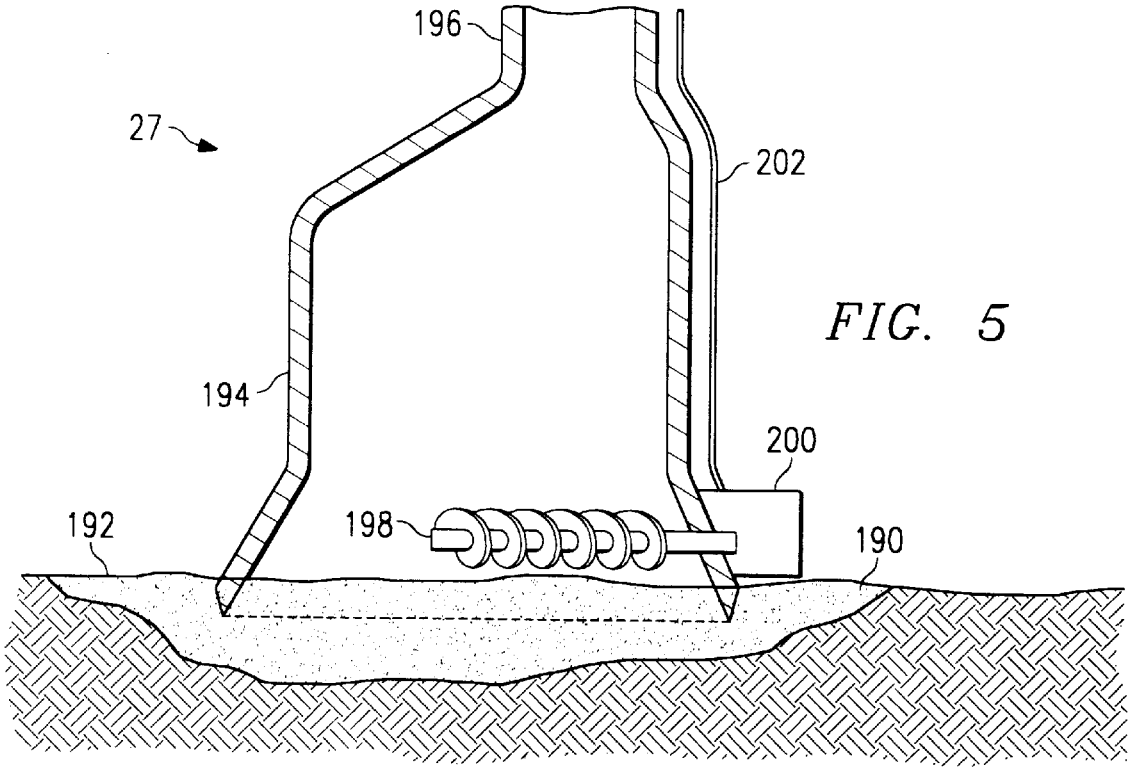
FIG. 5 is a side elevation view in cross-section of a collector according to an aspect of the present invention.

Referring now to FIG. 5, another hydrate recovery subsystem 27 is shown. As a primary means for causing hydrates 190 on ocean floor 192 to enter collector 194 and into conduit 196, subsystem 27 may include a mechanical agitator or auger 198 that is rotated or driven by a motor 200. Motor 200 may be electrical with power being supplied by line 202 or may be a fluid driven motor with fluid being supplied by line 202.

Figure 6:
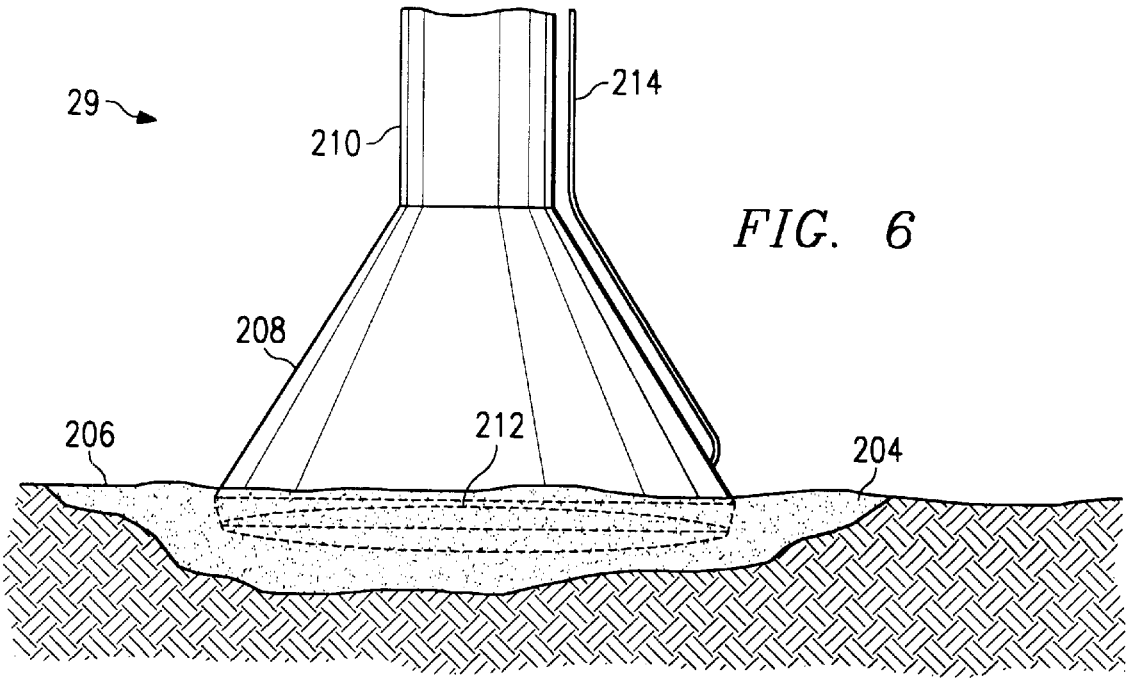
FIG. 6 is a side elevation view in cross-section of a collector according to an aspect of the present invention.

Referring now to FIG. 6, another hydrate recovery subsystem 29 is shown. As with FIGS. 4 and 5, subsystem 29 shows additional apparatuses and methodologies for causing hydrates 204 on ocean floor 206 to enter into collector 208 and on into conduit 210 that may be the primary means of hydrate removal or may supplement hydrate recovery systems previously presented. System 29 includes an electrical resistive heating element or plurality of resistive heating elements 212 that may be cause to bear upon hydrate formation 204 to supply heat thereto. Resistive heating element 212 is energized by power line 214. The increasing temperature of hydrates 204 will cause the gas locked therein to be released into collector 208 and conduit 210. As an alternative embodiment, waste heat from the gas conversion subsystem may be channeled to a hydrate recovery subsystem in the form of steam or hot water.

D. GAS CONVERSION SUBSYSTEM

The gas conversion subsystem converts the gas recovered from the hydrates into heavier hydrocarbons or liquids that may be more readily transported, such as by a transport tanker, while also producing excess power to facilitate hydrate recovery by a hydrate recovery subsystem. In this regard, a synthetic production of hydrocarbons using the Fischer-Tropsch is the preferred methodology for the gas conversion. Reference is made to U.S. Pat. No. 4,883,170, entitled Process and Apparatus for the Production of Heavier Hydrocarbons from Gaseous Light Hydrocarbons, and U.S. Pat. No. 4,973,453, entitled Apparatus for the Production of Heavier Hydrocarbons from Gaseous Light Hydrocarbons, both of which are herein incorporated by reference for all purposes. These two patents set out the background and technology that may be used as an aspect of the conversion subsystem. Additional aspects of the present invention for embodying the synthesis process for such a conversion are now presented. It is understood by one skilled in the art that various valves, heat exchangers, and separators may be included as part of the gas conversion subsystem. It is desirable to use a gas conversion subsystem with a small footprint to make ship mounting of the subsystem convenient.

Figure 7:
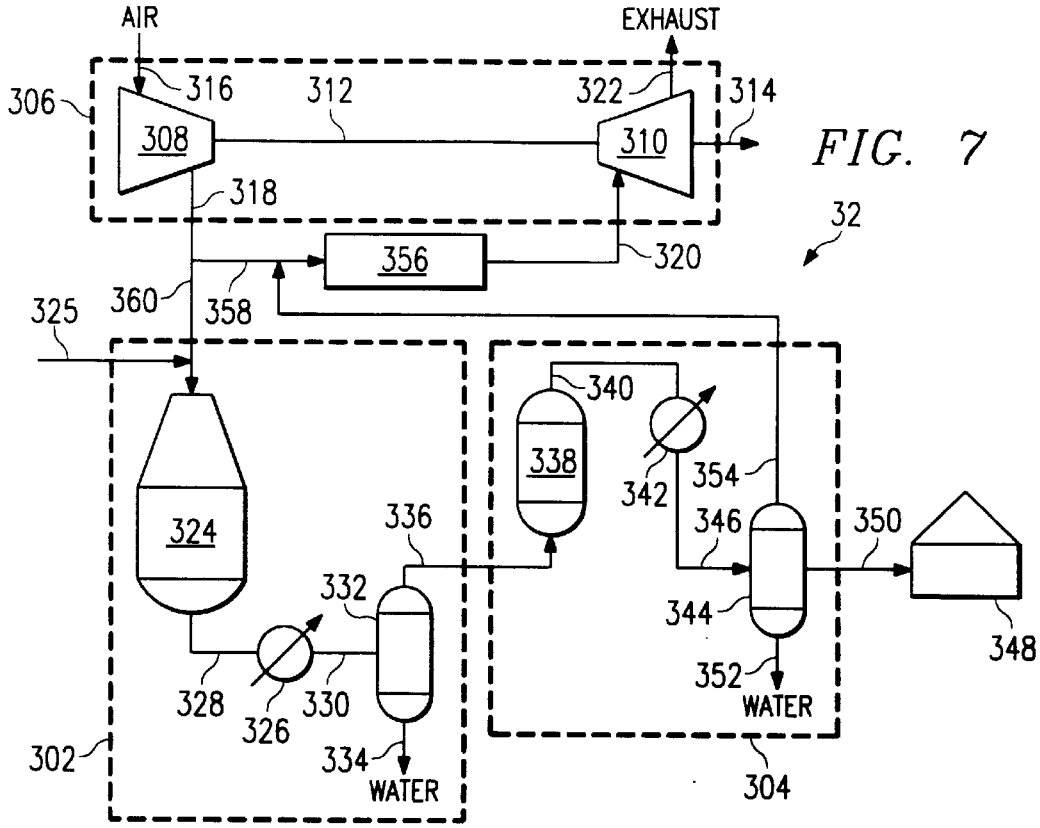
FIG. 7 is a schematic diagram of one embodiment of a gas conversion subsystem.

Referring now to FIG. 7, advantages may be obtained for a subsystem 32 by combining a synthesis gas unit 302 with a synthesis unit 304 and a gas turbine 306. The synthesis gas unit produces synthesis gas that is delivered to the synthesis unit where the synthesis gas is converted to a liquid or solid hydrocarbon form (hereafter "liquid hydrocarbons"). System 32 uses gas turbine 306 to provide power for the conversion process at a minimum, but is preferably designed to provide at least some additional power, which may be used to power or assist a hydrate recovery subsystem.

Gas turbine 306 has a compressor section 308 and an expansion turbine section 310. The power generated by the expansion turbine section 310 drives the compressor section 308 by means of linkage 312, which may be a shaft, and any excess power beyond the requirements of compressor section 308 may be used to generate electricity or drive other equipment as figuratively shown by output 314. Power takeoff 314 may be coupled to a hydrate recovery subsystem to provide electrical or mechanical power thereto. Compressor section 308 has inlet or conduit 316, where in the embodiment shown compressor 308 receives air. Compressor section 308 also has an outlet or conduit 318 for releasing compressed air. Expansion turbine 310 has inlet or conduit 320 and outlet or conduit 322. Outlet 318 of compressor section 308 provides compressed air to synthesis gas unit 302 through conduit 360.

Synthesis gas unit 302 may take a number of configurations, but in the specific embodiment shown, includes syngas reactor 324, which as shown here may be an autothermal reforming reactor. A stream of gaseous light hydrocarbons, e.g., a natural gas stream, is delivered to syngas reactor 324 by inlet or conduit 325. Conduit 325 is where gas from the hydrate recovery subsystem is delivered; for example, conduit 162 of FIG. 3 may be directly coupled to inlet 325 of FIG. 7. The synthesis gas unit 302 may also include one or more heat exchangers 326, which in the embodiment shown is a cooler for reducing the temperature of the synthesis gas exiting outlet 328 of syngas reactor 324. Heat exchanger 326 delivers its output to inlet 330 of separator 332. Separator 332 removes moisture which is delivered to outlet 334. It may be desirable in some instances to introduce the water in conduit 334 as steam to expansion turbine 310. Synthesis gas exits separator 332 through outlet or conduit 336. The synthesis gas exiting through outlet 336 is delivered to synthesis unit 304.

Synthesis unit 304 may be used to synthesize a number of materials, but in the specific example here is used to synthesize heavier hydrocarbons. Synthesis unit 304 includes Fischer-Tropsch (F-T) reactor 338, which contains an appropriate catalyst, e.g., an iron or cobalt based catalyst. The output of Fischer-Tropsch reactor 338 is delivered to outlet 340 from which it travels to heat exchanger 342 and on to separator 344.

The product entering separator 344 is first delivered to inlet 346. Separator 344 distributes the heavier hydrocarbons separated therein to storage tank or container 348 through outlet or conduit 350. Storage tank or container 348 is part of a storage and removal subsystem, which may, for example, be located directly on the vessel holding the gas conversion subsystem 32 or may be on a tanker ship attached thereto, as will be described further below. Conduit 350 may include additional components such as a conventional fractionation unit. Water withdrawn from separator 344 is delivered to outlet or conduit 352. It may be desirable in some instances to deliver the water in conduit 352 as steam into expansion turbine 310. The residue gas from separator 344 exits through outlet or conduit 354.

System 32 includes a combustor 356 associated with the turbine. Combustor 356 receives air from compression section 308 delivered through conduit 358 which is fluidly connected to conduit 360 connecting outlet 318 with syngas reactor 324. Also, residue gas delivered by separator 344 into conduit 354 is connected to combustor 356. Residue gas within conduit 354 is delivered to conduit 358 and then to combustor 356 as fuel. Additional processing of the residue gas may take place before delivery to combustor 356. Intermediate conduit 360 and the connection of conduit 354 with conduit 358 may be a valve (not explicitly shown) for dropping the pressure delivered from compressor section 308 to combustor 356 in order to match the pressure in conduit 354 as necessary. The output of combustor 356 is delivered to expansion turbine 310. In some embodiments, combustor 356 may be incorporated as part of gas turbine 306 itself, and in other embodiments, the syngas reactor 324 and combustor 356 may be combined to form a combination ATR and combustor.

Figure 8:
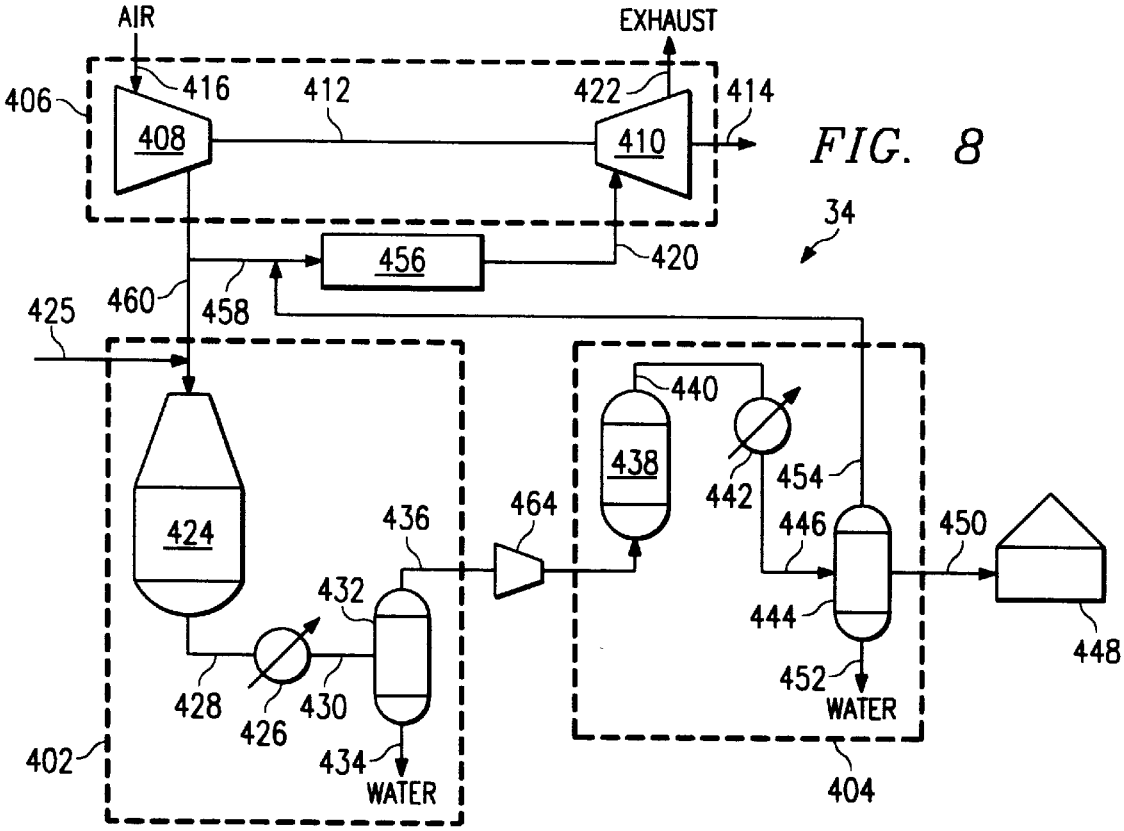
FIG. 8 is a schematic diagram of another embodiment of a gas conversion subsystem.

Referring to FIG. 8, another gas conversion subsystem 34 is shown. The system 34 is analogous in most respect to subsystem 32. Analogous or corresponding parts are shown with reference numerals having the same last two digits to show their correspondence with that of FIG. 7. The modifications in FIG. 8 are described below.

The preferred operating pressure of the front-end process described in connection with FIGS. 7–8 is in the range of 50 psig to 500 psig. The more preferred operating pressure is 100 psig to 400 psig. This relatively low operating pressure has the benefit of being in the range of most gas turbines so additional compression is minimized. Also, the operating of the syngas production unit 302 (FIG. 7) at relatively low pressure has the benefit of improved efficiency of the reforming reactions resulting in higher conversion of carbonaceous feeds like natural gas into carbon monoxide instead of carbon dioxide. Additionally, undesirable reactions that lead to the formation of carbon are less likely to occur at lower pressures.

In some instances, it may be desirable to increase the process pressure of subsystem 32 if the pressure drop is too great to recover sufficient energy to drive the compressor section 308 or if the catalyst used in the Fischer-Tropsch reactor 338 requires higher operating pressure. In either case, if higher pressure is required, the synthesis gas produced in syngas unit 302 may be further compressed by compressor 464, as shown in FIG. 8.

In this configuration (FIG. 8), the syngas unit 402 is operated at a relatively low pressure for the reasons provided above (greater efficiency of reactor 324 and less probability of forming solid carbons) while the Fischer-Tropsch reactor 438 is operated at an elevated pressure. This configuration of subsystem 34 has the advantage of recovering more power for turbine 406, but most of this power will probably be required to drive the syngas booster compressors 464. This configuration also has the advantage of operating the Fischer-Tropsch reactors 438 at an elevated pressure which depending on the catalyst employed, improves the efficiency of that reaction. Numerous modifications or adjustments may be made to subsystems 32 and 34, but a key aspect of the present invention is that excess energy from subsystems 32 and 34 are directed to power and assist hydrate recovery subsystems 22, 23, 24, 25, 27 and 29.

D. STORAGE AND REMOVAL SUBSYSTEM

Storage and removal subsystems 42 and 44 may take a number of embodiments, but are designed to hold gas, if desirable, prior to processing by gas conversion subsystems 31, 32 and 34, and to hold liquid hydrocarbons while waiting for transport to shore and for making removal from storage convenient. Referring to FIG. 1, storage and removal subsystem 42 is shown as being an aspect of vessel 50. In this embodiment, vessel 50 may contain large storage tanks for holding the liquid hydrocarbons delivered by gas conversion subsystem 26. Additionally, as shown in FIG. 3, storage and removal subsystem 42 may include a gas storage tank 161 for collecting gas recovered from the hydrates prior to processing with a gas conversion subsystem, such as gas conversion subsystem 31. A tanker vessel may link to vessel 50 for off-loading of liquid hydrocarbons from storage in subsystem 42.

Referring now to FIG. 2, storage and removal subsystem 44 is shown, including a storage facility 43 for holding liquid hydrocarbons produced by a gas conversion subsystem 28. System 44 may also include a gas storage facility such as gas storage 161 of FIG. 3.

Systems 10 and 12 may also allow for gas conversion subsystems to be located on a separate vessel, such as vessel or ship 17 of FIG. 2, which is shown with a gas conversion subsystem 34 and a storage tank 45 for storing liquid hydrocarbons as part of a storage and removal subsystem. Alternatively, vessel 17 may just be a storage tanker linked by linking means 47 for delivery of liquid hydrocarbons from conversion subsystem 28 directly or from an intermediate storage 43.

E. CONCLUSION

Although the present invention and its advantages have been described in detail, it should be understood that various changes, substitutions, and alterations can be made therein without departing from the spirit and scope of the invention as defined by the appended claims.

What is claimed is:

1. A system for recovering liquid hydrocarbons from gas from hydrates of a hydrate formation on an ocean floor, the system comprising:

a vessel;

a positioning subsystem coupled to the vessel for holding the vessel in a desired location over the hydrate formation;

a hydrate-recovery subsystem coupled to the vessel for delivering gas from the hydrates on an ocean floor to the vessel and separating gas from the hydrates;

a gas-conversion subsystem coupled to the hydrate recovery subsystem for receiving gas from the hydrate recovery subsystem and converting the gas to liquid hydrocarbons;

a storage and removal subsystem coupled to the gas-conversion subsystem for holding liquid hydrocarbons produced by the gas-conversion subsystem; and wherein excess power generated by the gas-conversion subsystem is supplied to the hydrate-recovery subsystem.

2. The system of claim 1, wherein the hydrate-recovery subsystem comprises:

a main conduit having a first end and a second end, the second end fluidly coupled to the gas-conversion subsystem; and a collector coupled to the first end of the conduit for receiving hydrates from the ocean floor.

3. The system of claim 2, wherein the hydrate-recovery subsystem further comprises a gas injection line coupled to the main conduit and a gas lift valve, wherein the gas injection line and gas lift valve are operable to start a self-sustaining flow of water and gas within the main conduit.

4. The system of claim 2, wherein the hydrate-recovery subsystem further comprises an internal liquid delivery conduit disposed within the main conduit and having a first end and a second end, the first end of the internal liquid delivery conduit coupled to the hydrate-recovery subsystem proximate the first end of the main conduit, a pump coupled to the second end of the internal liquid delivery conduit for forcing water therethrough.

5. The system of claim 4, wherein the first end of the internal liquid delivery conduit is formed with a plurality of perforations.

6. The system of claim 2, wherein the collector of the hydrate-recovery subsystem further comprises:

a first electrically conductive section;

a second electrically conductive section;

an insulation material disposed between the first conductive section and second conductive section; and an electrical lead coupled to the gas conversion subsystem for receiving energy therefrom to cause an electrical current to flow between the first conductive section and second conductive section.

7. The system of claim 2, wherein the hydrate-recovery subsystem further comprises an agitator coupled to the hydrate-recovery subsystem proximate the collector for agitating the hydrates on the ocean floor.

8. The system of claim 2, wherein the hydrate-recovery subsystem further comprises:

a plurality of heating elements coupled to the collector; and an electrical lead coupled to the plurality of heating elements and the gas conversion subsystem for receiving electrical energy therefrom to heat the plurality of heating elements.

9. The system of claim 2, wherein the gas conversion subsystem comprises:

a synthesis gas unit for producing a synthesis gas;

a synthesis unit coupled to the synthesis gas unit for receiving and converting the synthesis gas to liquid hydrocarbons; and a turbine coupled to the synthesis unit and synthesis gas unit, the turbine for compressing air provided to the synthesis gas unit and developing energy to power the gas-conversion subsystem and at least a portion of the hydrate-recovery subsystem.

10. The system of claim 2, wherein the gas conversion subsystem comprises:

a synthesis gas unit for producing a synthesis gas;

a Fischer-Tropsch synthesis unit coupled to the synthesis gas unit for receiving the synthesis gas and converting the synthesis gas to liquid hydrocarbons;

a turbine coupled to the synthesis unit and synthesis gas unit, the turbine for compressing air provided to the synthesis gas unit and developing energy to power the gas-conversion subsystem and at least a portion of the hydrate-recovery subsystem; and wherein the turbine comprises a combustor, and wherein a portion of a residue gas from the Fischer-Tropsch synthesis unit is delivered to the combustor for use as a fuel therein.

11. The system of claim 2, wherein the gas conversion subsystem comprises:

a synthesis gas unit for producing a synthesis gas;

a Fischer-Tropsch synthesis unit coupled to the synthesis gas unit for receiving the synthesis gas and converting the synthesis gas to liquid hydrocarbons;

a turbine having a combustor, the turbine coupled to the Fischer-Tropsch synthesis unit and synthesis gas unit;

wherein the combustor and synthesis unit are fluidly coupled as an integral unit for producing synthesis gas and for providing energy from combustion to an expansion portion of the turbine; and a conduit coupled to the Fischer-Tropsch synthesis unit and the combustor, the conduit for delivery a portion of a residue gas from the Fischer-Tropsch Synthesis unit to the combustor for use therein as fuel.

12. A method for recovering liquid hydrocarbons from hydrates on an ocean floor, the method comprising:

positioning a vessel over a hydrate formation on the ocean floor;

delivering hydrates into a conduit wherein the hydrates decompose to include a gas;

delivering the gas to a synthesis gas conversion system;

using the synthesis gas conversion system to convert the gas to liquid hydrocarbons; and using energy from the synthesis gas conversion system in the step of delivering hydrates into the conduit.

13. The process of claim 12 wherein the step of delivering hydrates into a conduit comprises establishing a gas lift in the conduit to pull the hydrates off the ocean floor.

14. The process of claim 12 wherein the step of using the synthesis gas conversion system to convert the gas to liquid hydrocarbons comprises the steps of:

preparing a synthesis gas in a synthesis gas unit;

delivering the synthesis gas to a synthesis unit; and converting the synthesis gas to liquid hydrocarbons.

15. The process of claim 14 wherein the step of preparing synthesis gas comprises providing the gas from the hydrates and compressed air to an autothermal reformer; and wherein the step of converting the synthesis gas to liquid hydrocarbons comprises delivering the synthesis gas to a Fischer-Tropsch reactor to produce liquid hydrocarbons.

16. A system for recovering gas from hydrates of a hydrate formation on an ocean floor, the system comprising:

an ocean-going vessel;

a positioning subsystem coupled to the vessel for holding the vessel in a desired location over the hydrate formation;

a hydrate-recovery subsystem coupled to the vessel for delivering gas from the hydrates on the ocean floor to the vessel, wherein the hydrate-recovery subsystem comprises a main conduit having a first end and a second end, the second end of the main conduit fluidly coupled to the gas-conversion subsystem, and a collector coupled to the first end of the main conduit for receiving hydrates from the ocean floor;

a gas-conversion subsystem secured to the vessel, the gas-conversion subsystem coupled to the hydrate-recovery subsystem for receiving gas from the hydrate-recovery subsystem and converting the gas to liquid hydrocarbons, wherein the gas-conversion subsystem comprises: a synthesis gas unit for producing a synthesis gas, a Fischer-Tropsch synthesis unit coupled to the synthesis gas unit for receiving the synthesis gas and converting the synthesis gas to liquid hydrocarbons, and a turbine coupled to the synthesis unit and synthesis gas unit, the turbine for compressing air provided to the synthesis gas unit and developing energy to power the gas-conversion subsystem and at least a portion of the hydrate-recovery subsystem;

a storage and removal subsystem coupled to the gas-conversion subsystem for holding liquid hydrocarbons produced by the gas-conversion subsystem; and wherein excess power generated by the gas-conversion subsystem is supplied to the hydrate-recovery subsystem to at least partially power the hydrate-recovery subsystem.

17. The system of claim 16, wherein the turbine comprises a combustor, and wherein a portion of a residue gas from the Fischer-Tropsch synthesis unit is delivered to the combustor for use as fuel therein.

18. The system of claim 16, wherein the turbine comprises a combustor and wherein the turbine is coupled to the Fischer-Tropsch synthesis unit and synthesis gas unit, and wherein the combustor and synthesis unit are fluidly coupled as an integral unit for producing synthesis gas and for providing energy from combustion to an expansion portion of the turbine; and further comprising a conduit coupled to the Fischer-Tropsch synthesis unit and the combustor, the conduit for delivering a portion of a residue gas from the Fischer-Tropsch Synthesis unit to the combustor for use therein as fuel.

19. The system of claim 16, wherein the gas conversion subsystem is coupled to the positioning subsystem so that excess energy from the gas conversion subsystem provides a portion of any energy required by the positioning subsystem.

* * * * *